US011564551B2

(12) United States Patent
Boyer et al.

(10) Patent No.: US 11,564,551 B2
(45) Date of Patent: Jan. 31, 2023

(54) DISHWASHER WITH MOLDED TUBULAR SPRAY ELEMENT

(71) Applicant: Midea Group Co., Ltd., Foshan (CN)

(72) Inventors: Joel Boyer, Louisville, KY (US); Robert M. Digman, Goshen, KY (US)

(73) Assignee: MIDEA GROUP CO., LTD, Guangdong (CN)

( * ) Notice: Subject to any disclaimer, the term of this patent is extended or adjusted under 35 U.S.C. 154(b) by 241 days.

(21) Appl. No.: 17/022,786

(22) Filed: Sep. 16, 2020

(65) Prior Publication Data

US 2022/0079412 A1 Mar. 17, 2022
US 2022/0354334 A2 Nov. 10, 2022

(51) Int. Cl.

| | |
|---|---|
| ***A47L 15/23*** | (2006.01) |
| ***A47L 15/42*** | (2006.01) |
| *A47L 15/44* | (2006.01) |
| *A47L 15/50* | (2006.01) |

(52) U.S. Cl.
CPC ..... *A47L 15/23* (2013.01); *A47L 15/4219* (2013.01); *A47L 15/44* (2013.01); *A47L 15/507* (2013.01); *A47L 2501/12* (2013.01); *A47L 2501/20* (2013.01)

(58) Field of Classification Search
CPC ..... A47L 15/23; A47L 15/4219; A47L 15/44; A47L 15/507; A47L 2501/12; A47L 2501/20
See application file for complete search history.

(56) References Cited

U.S. PATENT DOCUMENTS

| | | | |
|---|---|---|---|
| 3,827,637 | A | 8/1974 | Stephany et al. |
| 3,854,665 | A | 12/1974 | Rodgers |
| 4,123,006 | A | 10/1978 | Yukishita |
| 5,098,020 | A | 3/1992 | Cooper et al. |
| 5,511,727 | A | 4/1996 | Heren et al. |
| 5,759,647 | A | 6/1998 | Kuroda et al. |
| 6,955,742 | B2 | 10/2005 | McKay et al. |
| 7,252,246 | B2 | 8/2007 | Heren et al. |
| 7,258,286 | B1 | 8/2007 | Wang et al. |
| 9,199,286 | B2 | 12/2015 | Jendrichowski et al. |

(Continued)

FOREIGN PATENT DOCUMENTS

| | | | |
|---|---|---|---|
| CN | 109124522 | A | 1/2019 |
| EP | 0368096 | A2 | 5/1990 |

(Continued)

OTHER PUBLICATIONS https://bearingsdirect.com/ball-bearings/double-row-ball-bearings/3200-series-light-duty/3200-2rs-double-row-ball-bearing-id-10-x-od-30-x-w-14-3-mm-sealed/Aug. 2020.*

(Continued)

*Primary Examiner* — Michael E Barr
*Assistant Examiner* — Pallavi Chitta
(74) *Attorney, Agent, or Firm* — Gray Ice Higdon

(57) ABSTRACT

A tubular spray element for a dishwasher is formed in part from a molded elongated tube including one or more elongated slots formed in a sidewall thereof along one or more lengthwise portions of the elongated tube and one or more additional lengthwise portions in which the sidewall extends fully around a circumference of the elongated tube. In addition, one or more elongated caps are secured to the elongated tube and are sized and configured to cover the elongated slot(s).

19 Claims, 6 Drawing Sheets

(56) References Cited

U.S. PATENT DOCUMENTS

| | | | | |
|---|---|---|---|---|
| 10,524,634 | B2 | 1/2020 | Digman | |
| 10,531,781 | B2 | 1/2020 | Digman et al. | |
| 10,631,708 | B2 | 4/2020 | Digman et al. | |
| 10,765,291 | B2 | 9/2020 | Digman et al. | |
| 2008/0271759 | A1* | 11/2008 | Burrows | A47L 15/23 134/172 |
| 2010/0043826 | A1 | 2/2010 | Bertsch et al. | |
| 2013/0000762 | A1 | 1/2013 | Buddharaju et al. | |
| 2014/0246059 | A1* | 9/2014 | Feddema | A47L 15/23 134/198 |
| 2016/0058264 | A1 | 3/2016 | Thiyagarajan | |
| 2017/0273535 | A1 | 9/2017 | Roderick et al. | |
| 2019/0099054 | A1* | 4/2019 | Digman | A47L 15/22 |
| 2020/0085277 | A1 | 3/2020 | Digman et al. | |
| 2020/0085279 | A1 | 3/2020 | Digman et al. | |
| 2020/0107696 | A1 | 4/2020 | Digman et al. | |
| 2021/0251462 | A1 | 8/2021 | Boyer | |

FOREIGN PATENT DOCUMENTS

| | | | | |
|---|---|---|---|---|
| EP | 0559466 | A1 | 9/1993 | |
| EP | 0826427 | A2 | 3/1998 | |
| WO | WO-2007147536 | A1 * | 12/2007 | A47L 15/23 |

OTHER PUBLICATIONS

Boyan Manufacturing Solutions, Custom Plastic Helical Gears, Retrieved on Jul. 1, 2020.

Gardiner, Ginger, Injection-Forming for High-Performance, Unitized Thermoplastic Structures, CompositesWorld, Jul. 30, 2019.

International Search Report and Written Opinion issued in Application No. PCT/CN2021/110530, dated Oct. 27, 2021, 10 pages.

* cited by examiner

DISHWASHER WITH MOLDED TUBULAR SPRAY ELEMENT

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

A different approach to traditional spray arm systems utilizes one or more tubular spray elements to spray utensils within a dishwasher. A tubular spray element is a type of rotatable conduit that both conveys wash fluid along its length and ejects the wash fluid through various apertures disposed on an exterior surface thereof. A tubular spray element is generally formed of an elongated body and rotates about a longitudinal axis thereof, either in a controllable or uncontrollable fashion, e.g., based upon an electric drive, a hydraulic drive, or as a result of rotational forces imparted by the ejection of wash fluid from the tubular spray element.

It has been found, however, that the manufacture of a tubular spray element can present challenges, particularly when a molded plastic construction is desired, and further when it is desirable to incorporate additional structures such as drive gears, nozzles, apertures, etc. into the construction. The elongated and tubular nature of a tubular spray element, in particular, can present challenges for conventional molding processes, where it is desirable to provide suitable strength throughout a tubular spray element while also providing repeatable and consistent wall thicknesses throughout.

SUMMARY

The herein-described embodiments address these and other problems associated with the art by providing a dishwasher, dishwasher sprayer, and method for making the same utilizing a tubular spray element formed in part from a molded elongated tube including one or more elongated slots formed in a sidewall thereof along one or more lengthwise portions of the elongated tube and one or more additional lengthwise portions in which the sidewall extends fully around a circumference of the elongated tube, coupled with one or more elongated caps secured to the elongated tube and sized and configured to cover the elongated slot(s). Such a design may be used, for example, to approximate an integral elongated tube having a high aspect ratio in a cost-effective manner.

Therefore, consistent with one aspect of the invention, a dishwasher may include a wash tub, a fluid supply configured to supply a wash fluid, and a tubular spray element disposed within the wash tub and being rotatable about a longitudinal axis thereof, the tubular spray element including a plurality of apertures in fluid communication with the fluid supply to direct wash fluid into the wash tub. The tubular spray element may further include an elongated tube formed of a molded polymer material and including an elongated slot formed in a sidewall thereof along a first lengthwise portion of the elongated tube, the elongated tube further including a second lengthwise portion in which the sidewall extends fully around a circumference of the elongated tube, and an elongated cap secured to the elongated tube, the elongated cap sized and configured to cover the elongated slot.

In some embodiments, the elongated cap is formed of a molded polymer material, and the elongated cap is secured to the elongated tube using vibration, ultrasonic or laser welding. Also, in some embodiments, the elongated tube includes a generally planar support surface extending along opposing sides of the slot and supporting the elongated cap. Further, in some embodiments, the generally planar support surface extends into the second lengthwise portion of the elongated tube and at an end of the slot to support a portion of the elongated cap. In some embodiments, the plurality of apertures are disposed in the elongated cap.

In addition, in some embodiments, the first lengthwise portion is generally U-shaped in cross-section and the second lengthwise portion is generally O-shaped in cross-section. In some embodiments, the first lengthwise portion includes a plurality of annular ribs extending in transverse planes relative to the longitudinal axis.

In addition, in some embodiments, the tubular spray element further includes a drive member coupled to the second lengthwise portion of the elongated tube, and the dishwasher further includes a tubular spray element drive operably coupled to the drive member to rotate the tubular spray element about the longitudinal axis. Moreover, in some embodiments, the drive member includes a gear. In some embodiments, the gear is integrally molded with the elongated tube. Moreover, in some embodiments, the gear includes first and second opposing sides and is positioned at an intermediate location of the second portion of the elongated tube such that the second portion of the elongated tube extends lengthwise from both opposing sides of the gear.

Some embodiments may also include a tubular spray element support disposed on a wall of the wash tub and configured to support the tubular spray element on the wall of the wash tub in a cantilevered fashion, the tubular spray element support including a fluid inlet in fluid communication with the fluid supply and configured to communicate wash fluid from the fluid supply to the tubular spray element, the tubular spray element support including an aperture through which the tubular spray element projects, and the tubular spray element support being configured to retain the drive member within the housing.

In some embodiments, the tubular spray element includes a fluid inlet disposed within the tubular spray element support to receive wash fluid that is communicated along the elongated tube to the plurality of apertures. In addition, some embodiments may also include first and second bearings disposed within the tubular spray element support to rotatably support the tubular spray element at respective first and second locations along the longitudinal axis thereof. In some embodiments, the elongated tube includes an annular groove disposed proximate a first end of the elongated tube to receive a retaining clip that retains the tubular spray element within the tubular spray element support. Some embodiments may further include a valve body having a radially-facing inlet in fluid communication with an internal channel of the tubular spray element, and the tubular spray element support includes a radially-facing valve member disposed at a predetermined radius from the longitudinal axis to substantially block fluid flow from the inlet of the tubular spray element support to the radially-facing inlet when the tubular spray element is rotated to a predetermined rotational position about the longitudinal axis.

Consistent with another aspect of the invention, a tubular spray element configured to spray wash fluid from a fluid supply into a wash tub of a dishwasher may include an elongated tube configured to rotate about a longitudinal axis, the elongated tube formed of a molded polymer material and including an elongated slot formed in a sidewall thereof along a first lengthwise portion of the elongated tube, the elongated tube further including a second lengthwise portion in which the sidewall extends fully around a circumference of the elongated tube, an elongated cap secured to the elongated tube, the elongated cap sized and configured to cover the elongated slot, and a plurality of apertures disposed in at least one of the elongated tube and the elongated cap, the plurality of apertures configured to receive wash fluid from the fluid supply and direct the wash fluid externally from the tubular spray element and into the wash tub.

In addition, some embodiments may further include a gear integrally molded with the elongated tube and rotating in a plane that is generally transverse to the longitudinal axis, and the gear includes first and second opposing sides and is positioned at an intermediate location of the second portion of the elongated tube such that the second portion of the elongated tube extends lengthwise from both opposing sides of the gear. In some embodiments, the elongated cap is formed of a molded polymer material and is secured to the elongated tube using vibration, ultrasonic or laser welding, the plurality of apertures are disposed in the elongated cap, the first lengthwise portion is generally U-shaped in cross-section and the second lengthwise portion is generally O-shaped in cross-section, and the first lengthwise portion includes a plurality of annular ribs extending in transverse planes relative to the longitudinal axis.

Consistent with another aspect of the invention, a method of manufacturing a tubular spray element configured to rotate about a longitudinal axis while spraying wash fluid within a wash tub of a dishwasher may include molding an elongated tube having a longitudinal axis from a first polymer material to include an elongated slot formed in a sidewall thereof along a first lengthwise portion of the elongated tube, the elongated tube further including a second lengthwise portion in which the sidewall extends fully around a circumference of the elongated tube and a gear disposed in the second lengthwise portion and extending within a plane that is generally transverse to the longitudinal axis, molding an elongated cap from a second polymer material, the elongated cap including a plurality of apertures configured to spray the wash fluid into the wash tub, and welding the elongated cap to the elongated tube to cover the elongated slot.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
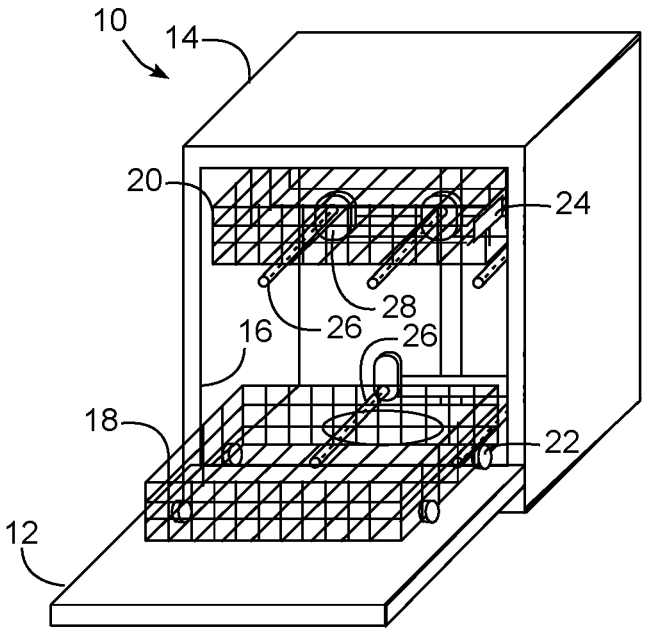
FIG. 1 is a perspective view of a dishwasher consistent with some embodiments of the invention.

In some embodiments consistent with the invention, a tubular spray element is formed in part from a molded elongated tube including one or more elongated slots formed in a sidewall thereof along one or more lengthwise portions of the elongated tube and one or more additional lengthwise portions in which the sidewall extends fully around a circumference of the elongated tube. In addition, one or more elongated caps are secured to the elongated tube and are sized and configured to cover the elongated slot(s).

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray element may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
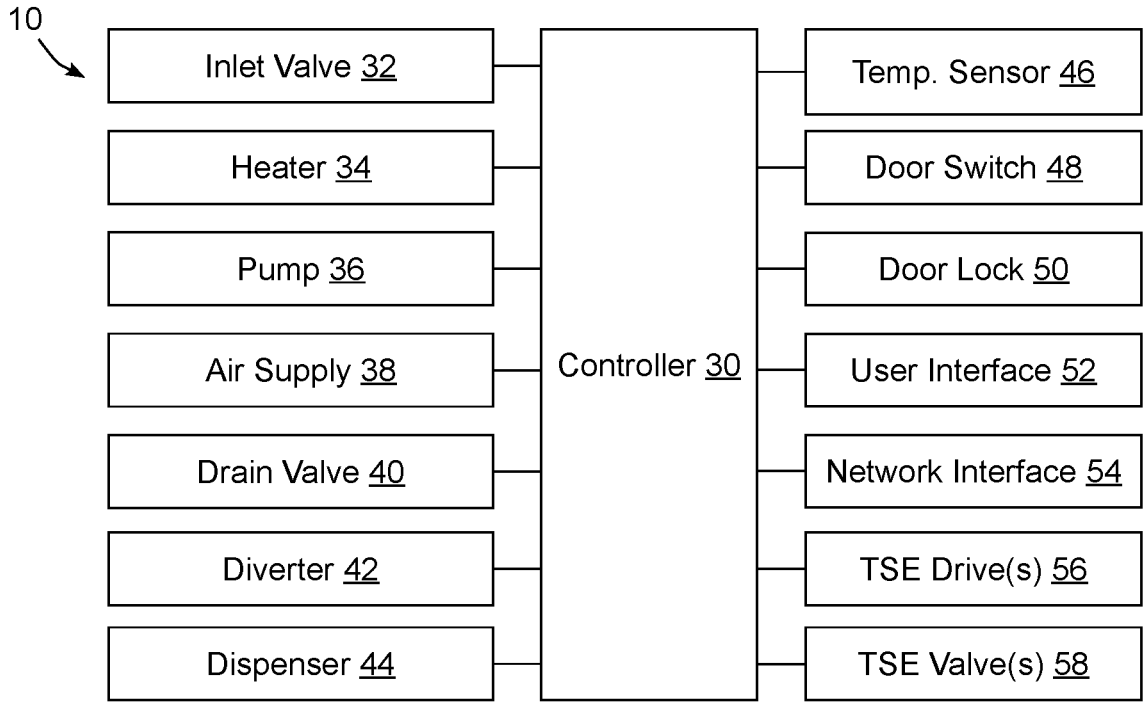
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
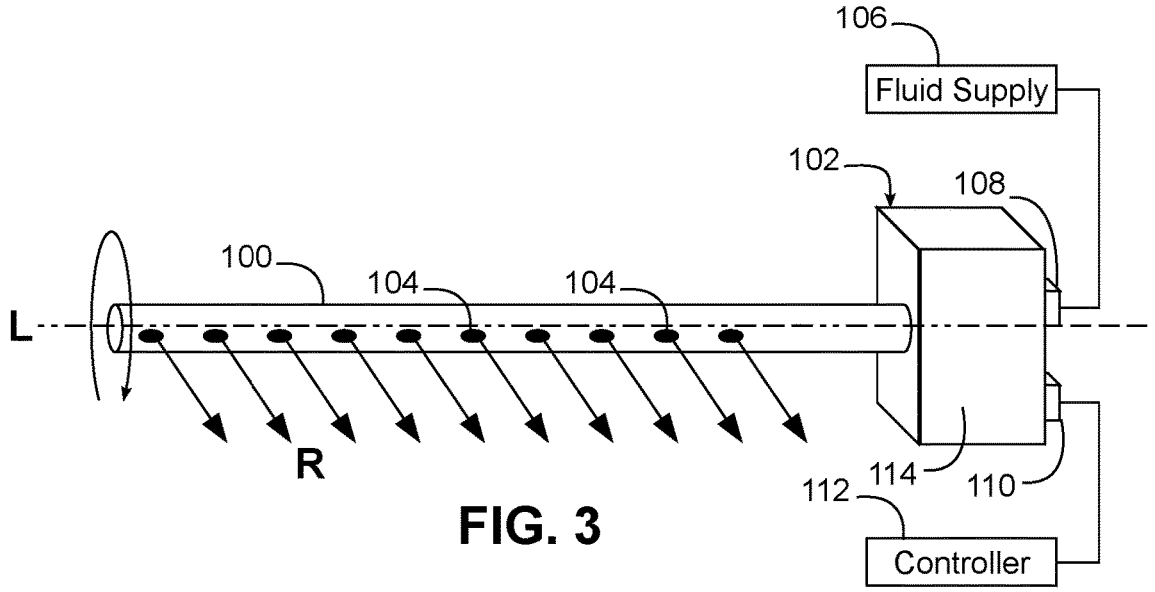
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
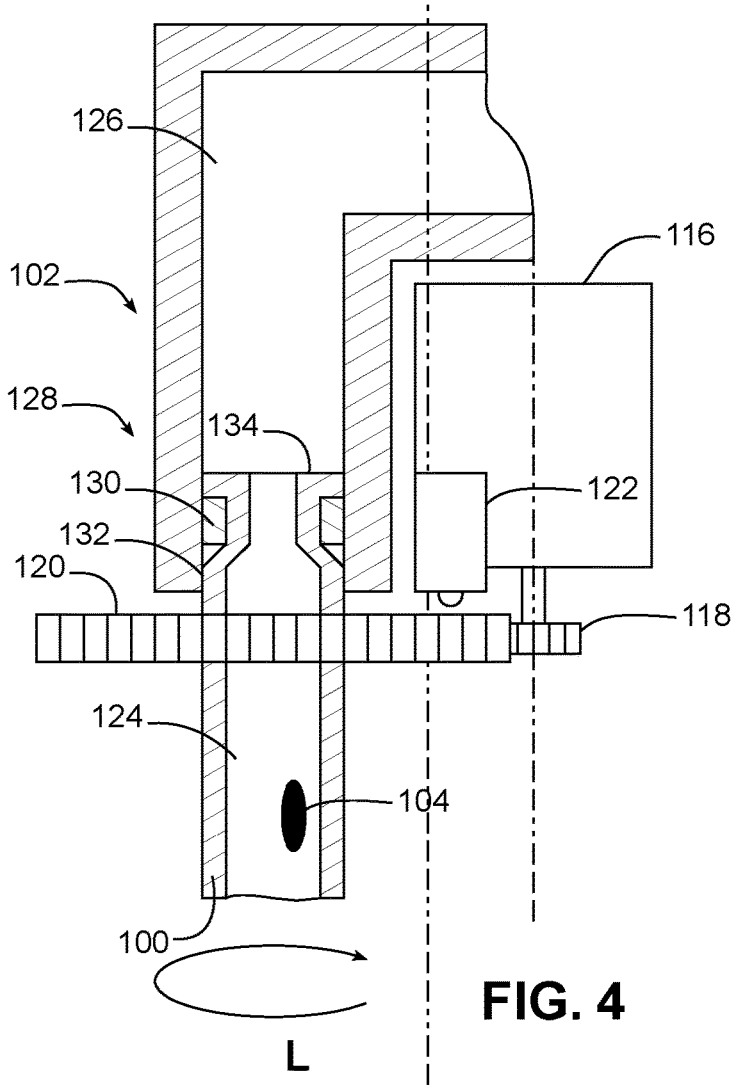
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pulley drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
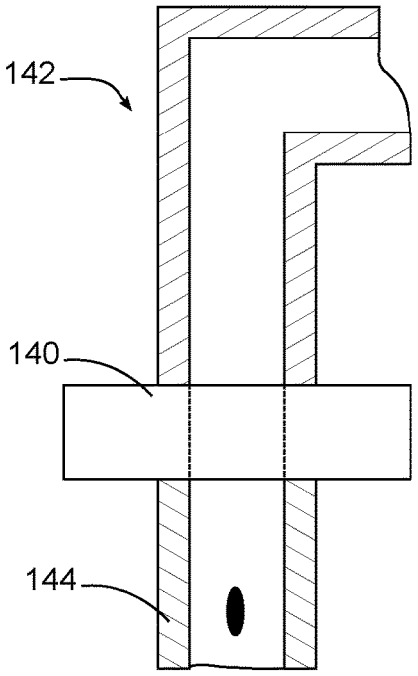
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
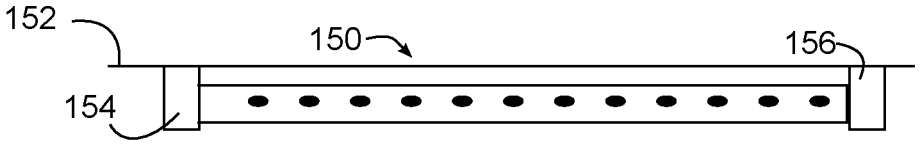
FIG. 6 is a functional top plan view of an example implementation of a wall-mounted tubular spray element and tubular spray element drive consistent with some embodiments of the invention.
Figure 7:
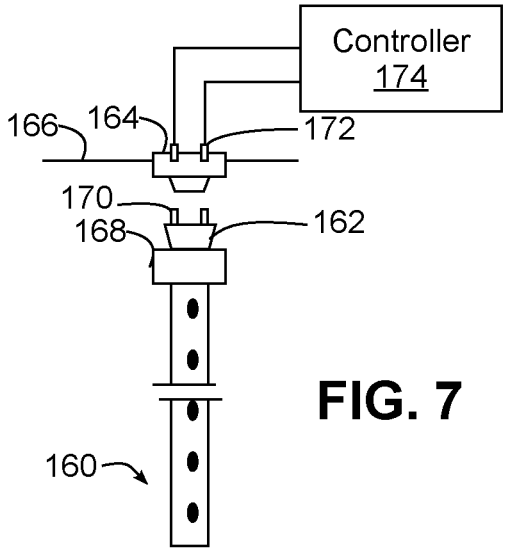
FIG. 7 is a functional top plan view of an example implementation of a rack-mounted tubular spray element and tubular spray element drive consistent with some embodiments of the invention.
Figure 8:
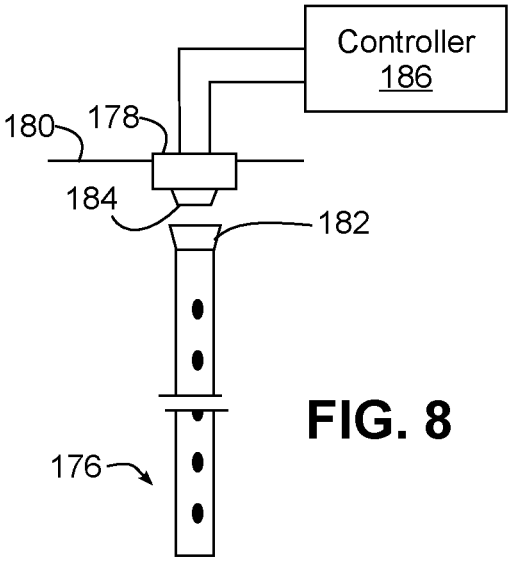
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
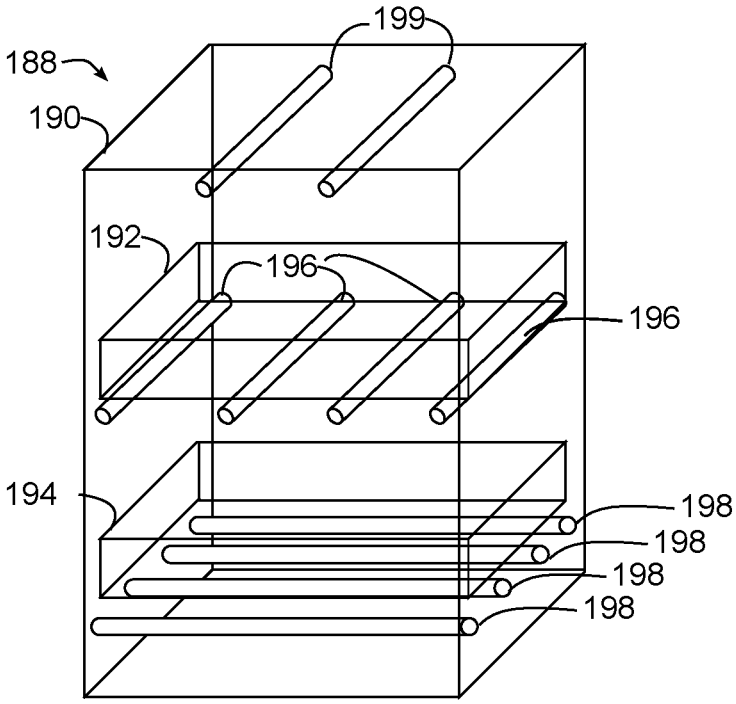
FIG. 9 is a functional perspective view of a dishwasher incorporating multiple tubular spray elements and consistent with some embodiments of the invention.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Molded Tubular Spray Element

Figure 10:
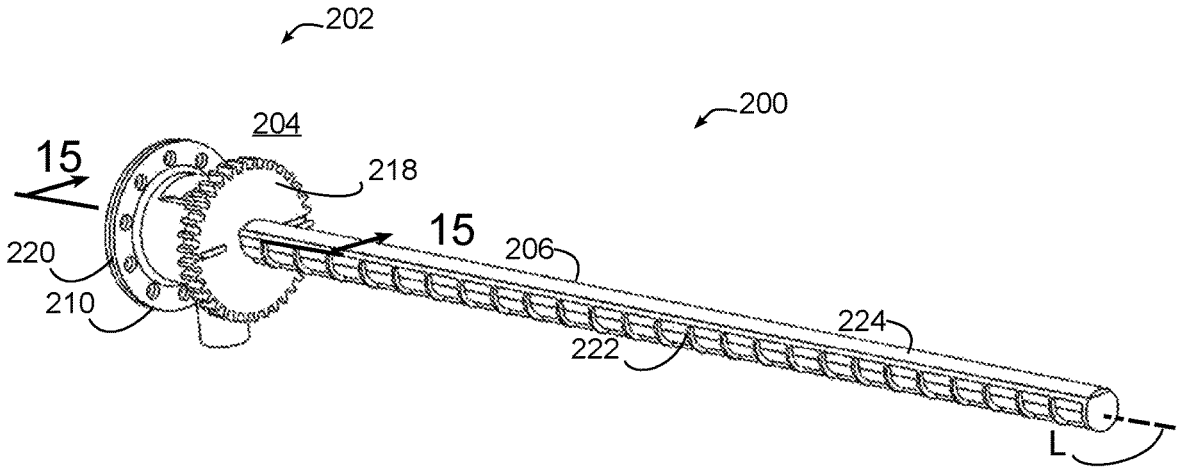
FIG. 10 is a perspective view of an example implementation of wall-mounted tubular spray element spraying system consistent with some embodiments of the invention.
Figure 11:
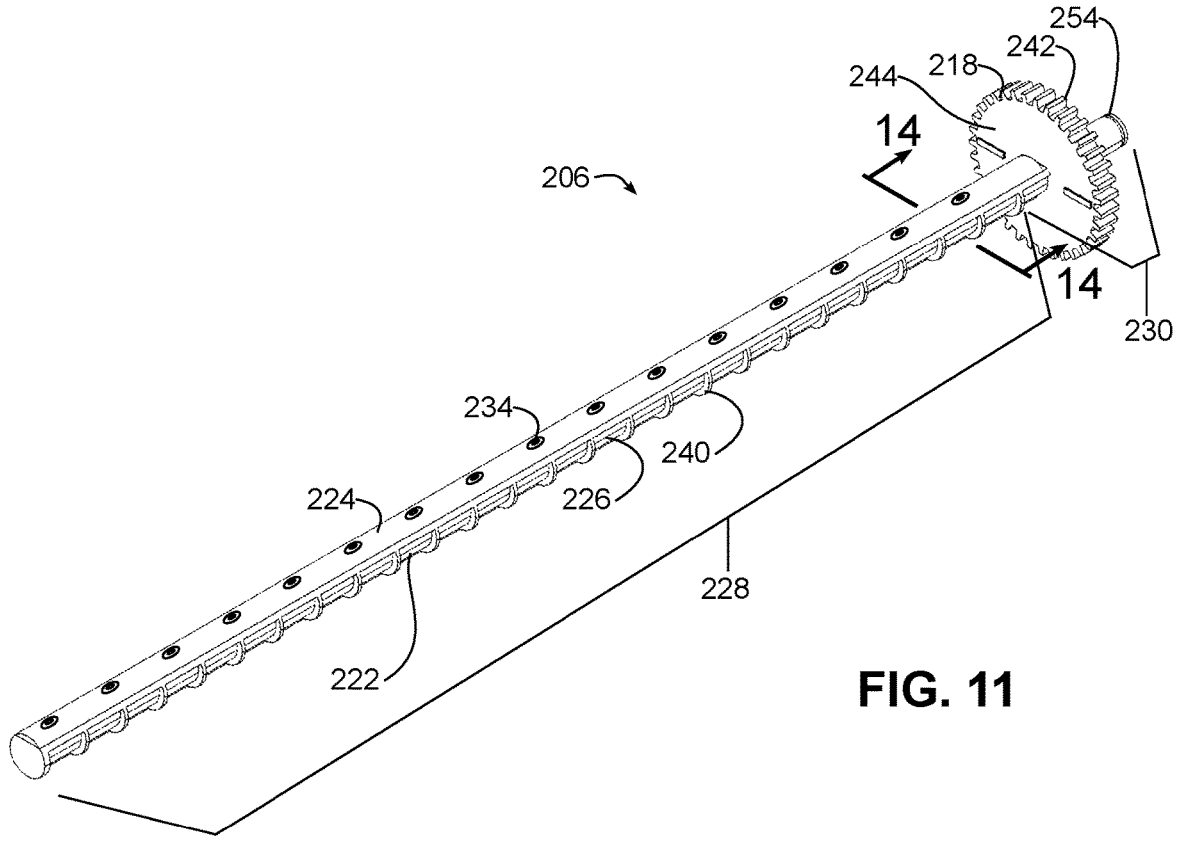
FIG. 11 is a perspective view of one of the tubular spray elements illustrated in FIG. 10.

Now turning to FIGS. 10-15, and initially with reference to FIG. 10, an example dishwasher 200 is illustrated, which includes a dishwasher spray system 202 disposed on a wash tub wall 204, and including a tubular spray element 206 supported by a tubular spray element support 210. Tubular spray element support 210 in the illustrated embodiment operates in part as a manifold to distribute fluid from a fluid supply (not shown in FIG. 10) to tubular spray element 206. A tubular spray element drive (not shown in FIG. 10) drives rotation of tubular spray element 206, e.g., through a gear 218 of tubular spray element 206, about a longitudinal axis L. Tubular spray element drive 212 may include, for example, a stepper motor or other type of electrical, hydraulic, or other suitable drive, and may include a driving gear that engages gear 218 on tubular spray element 206. A housing 220 of tubular spray element support 210 in some embodiments may enclose a tubular spray element drive, as well as various fluid passageways, diverter valves, check valves, flow control valves, and other structures, e.g., any of the various components and structures described in U.S. Pat. No. 10,631,708, which is assigned to the same assignee as the present application and which is incorporated by reference herein. A tubular spray element support may also support multiple tubular spray elements in other embodiments.

As noted above, the manufacture of a tubular spray element can present challenges, particularly when a molded plastic construction is desired, and further when it is desirable to incorporate additional structures such as gears, nozzles, apertures, etc. into the construction. One particularly desirable and cost effective configuration of tubular spray element, for example, would be constructed of a polymer material with support structures such as gears, nozzles, apertures, etc. molded integrally into the construction. The elongated and tubular nature of a tubular spray element, however, can present challenges for conventional molding processes, where it is desirable to provide suitable strength throughout a tubular spray element while also providing repeatable and consistent wall thicknesses throughout.

In the illustrated embodiments, these concerns are mitigated by forming a tubular spray element using a combination of an elongated tube and one or more elongated caps that are secured to one another to form the main structure of the tubular spray element. The elongated tube may be formed of a molded polymer material and may include one or more elongated slots formed in a sidewall thereof along one or more lengthwise portions of the elongated tube, as well as one or more additional lengthwise portions in which the sidewall extends fully around a circumference of the elongated tube to provide additional structural rigidity to the elongated tube, particularly in regions thereof used for supporting the tubular spray element and/or incorporating drive members such as gears and the like. Each elongated cap, in turn, may be secured to the elongated tube, and may be sized and configured to cover at least a portion of the elongated slot. In some embodiments, the elongated cap may also be formed of a molded polymer material that is the same as or is different from that used for the elongated tube, and may be secured to the elongated tube in various manners, e.g., using various types of welding processes such as vibration, ultrasonic or laser welding, or otherwise using other types of securement technologies such as adhesives, fasteners, snap-fit arrangements, etc. An elongated cap may be secured in a permanent or temporary/removable fashion in different embodiments, and in other embodiments, other materials may be used, e.g., stamped or cast metals, or combinations of metal and polymer components.

Figure 12:
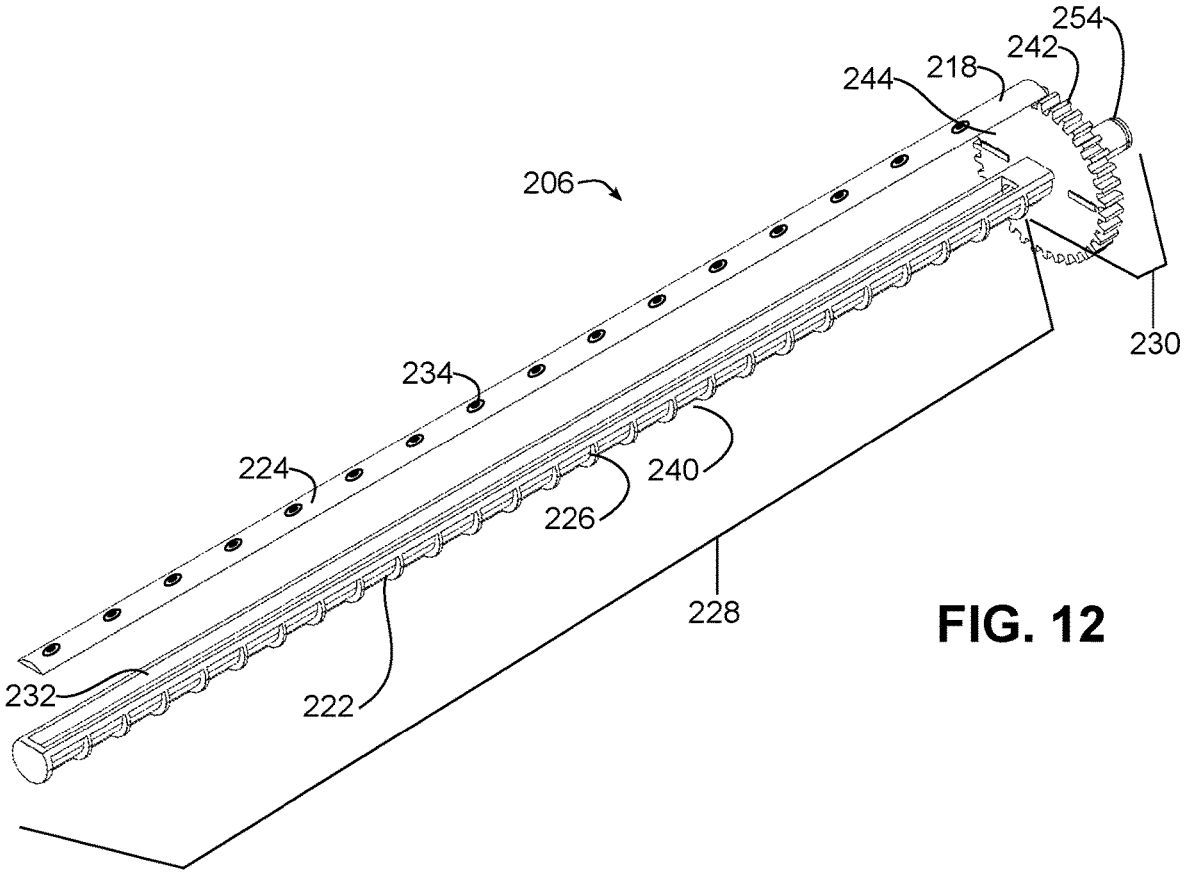
FIG. 12 is an exploded perspective view of the tubular spray element of FIG. 11.

FIG. 10, for example, illustrates tubular spray element 206 as including an elongated tube 222, an elongated cap 224 and an integrated gear 218. With additional reference to FIGS. 11-12, elongated tube 222 includes a sidewall 226 and is partitioned into lengthwise portions 228, 230, and as illustrated in FIG. 12, an elongated slot 232 extends in a lengthwise direction (i.e., in a direction generally parallel to the longitudinal axis L1) through lengthwise portion 228, such that sidewall 226 does not fully circumscribe the elongated tube. On the other hand, within lengthwise portion 230, sidewall 226 does fully circumscribe the elongated tube. While slot 232 is illustrated as having a generally rectangular shape, in other embodiments, other sizes and/or shapes of elongated slots may be used. Further, while elongated tube 222 includes a closed free end (i.e., the end distal from support 210), in other embodiments at least a portion of the free end may be formed by cap 224, or a separate structure such as a plug may close off the end.

Elongated cap 224 includes molded therein one or more apertures 234, which may be molded in various configurations to spray wash fluid in various patterns and/or with various flow rates. Apertures 234 may vary in number and/or size, and may also be configured to provide different spray characteristics. In some embodiments, fluidic nozzles may be molded into cap 224, while in other embodiments, apertures may be provided on rotatable, oscillating or other movable nozzles coupled to cap 224. Furthermore, while apertures 234 are disposed on cap 224 in the illustrated embodiment, in other embodiments, apertures may be disposed on elongated tube 222 in addition to or in lieu of apertures 234. It will also be appreciated that, by providing apertures 234 on cap 224, it may be desirable in some embodiments to support multiple caps 224 that may be permanently or removably secured to the same elongated tube 222 to support different spray patterns. By doing so, the same elongated tube 222 may be used for different types of sprayers, e.g., where it is desirable to use tubular spray elements in different locations in a dishwasher and customize each with different spray patterns to optimize spray characteristics, or to use the same elongated tube in different dishwasher models having different sizes and/or performance characteristics.

Figure 13:
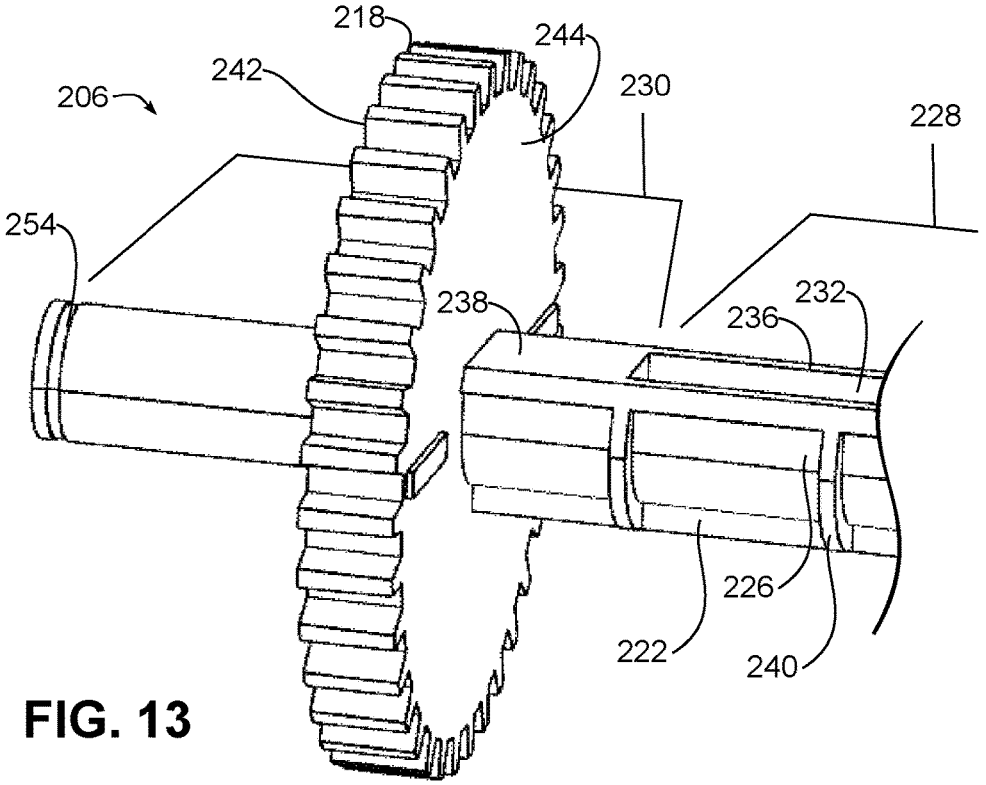
FIG. 13 is a partial enlarged perspective view of a main elongated tube of the tubular spray element of FIGS. 11-12.

With specific reference to FIGS. 12 and 13, in the illustrated embodiment it may be desirable to provide a generally planar support surface 236 that extends along opposing sides of slot 232 and that supports cap 224. In addition, in some embodiments, it may be desirable to allow cap 224 to partially overlay lengthwise portion 230, and thus, to provide an additional substantially planar support surface portion 238 proximate an end of the slot 232. By doing so, additional surface area for bonding cap 224 to elongated tube 222 may be provided, thereby providing additional rigidity to the finished part. Other support surface configurations may be used in other embodiments as is desired to join cap 224 to elongated tube 222 to adequately cover slot 232, as will be appreciated by those of ordinary skill having the benefit of the instant disclosure.

Figure 14:
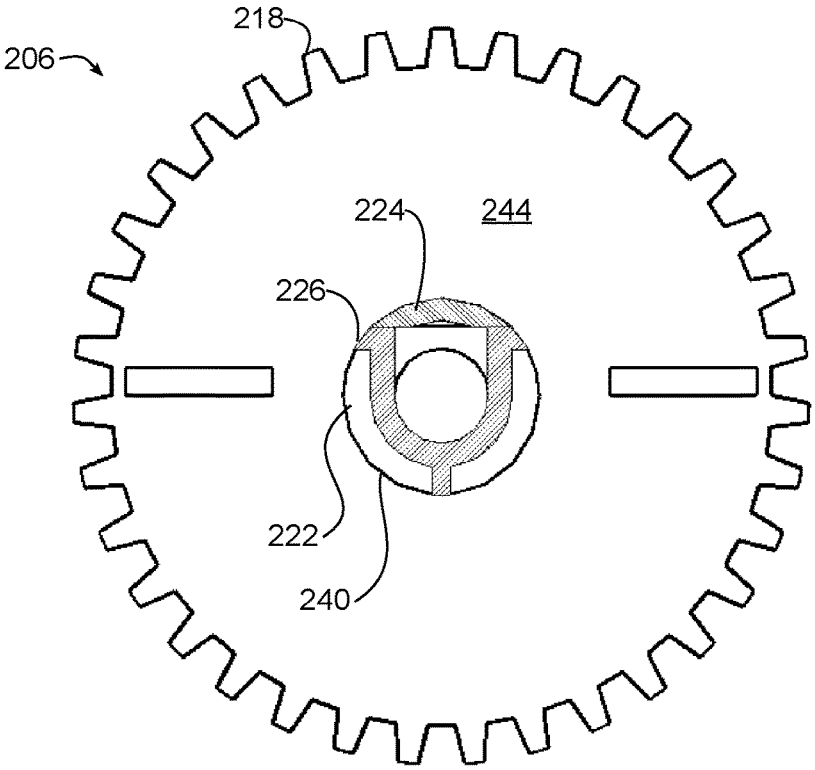
FIG. 14 is a cross-sectional view of the tubular spray element of FIG. 11, taken through lines 14-14 thereof.

In addition, with additional reference to FIG. 14, it may be desirable in some embodiments to configure lengthwise portion 228 of elongated tube 222 with a generally U-shaped cross-section, with the slot 232 forming the open end of the U-shape, while configuring lengthwise portion 230 of elongated tube 222 with a generally O-shaped cross-section. In addition, in some embodiments it may be desirable to form various support structures on tubular spray element 206 to add rigidity and strength to the element, e.g., one or more annular ribs 240 that are formed in elongated tube 222 and extend in transverse planes relative to the longitudinal axis L1.

As noted above, elongated tube 222 may also have integrally molded therewith a gear 218 or other driving member. In the illustrated embodiment, the gear is formed within lengthwise portion 230 of elongated tube 222, although in other embodiments, a gear, other driving member or other structure may be secured to the tubular spray element in other manners, e.g., using set screws, adhesives, fasteners, snap-fit arrangements, etc. Moreover, in the illustrated embodiment, it may be desirable to integrally mold gear 218 at an intermediate location within lengthwise portion 230, i.e., such that lengthwise portion 230 extends lengthwise from both opposing sides 242, 244 of gear 218, thereby providing sufficient rigidity and strength along elongated tube 222 in the region of gear 218.

Figure 15:
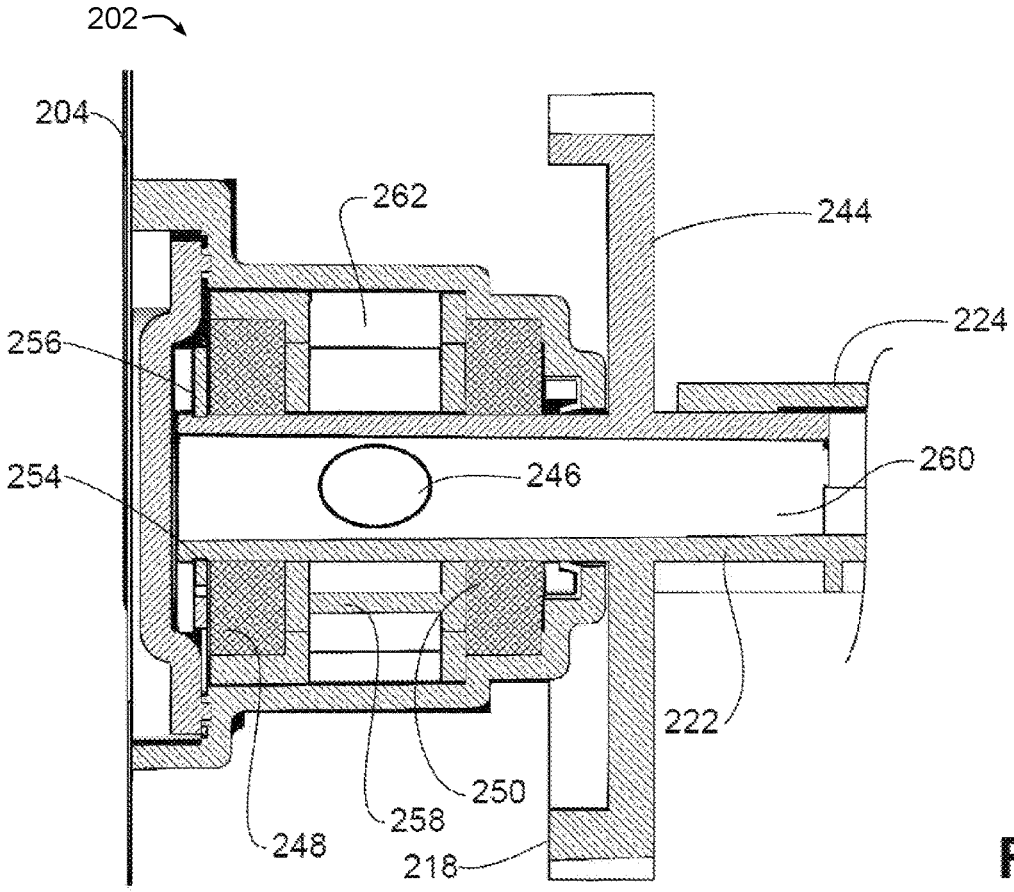
FIG. 15 is a cross-section view of the wall-mounted tubular spray element spraying system of FIG. 10, taken through lines 15-15 thereof.

With particular reference to FIGS. 10 and 15, in some embodiments, tubular spray element 206 may be supported in a cantilevered fashion by tubular spray element support 210 disposed on wash tub wall 204, and support 210 may also function as a manifold to communicate wash fluid from a fluid supply through a fluid inlet (not shown in FIG. 15) to tubular spray element 206. Tubular spray element 206 may project through an aperture 252 with at least a portion thereof, e.g., at least a portion of lengthwise portion 230 and gear 218 retained within housing 220.

In some embodiments, tubular spray element 206 may be rotatably supported within support 210 using one or more bearings, e.g., bearings 248, 250 disposed at different lengthwise locations along the tubular spray element. An annular groove 254 may be formed proximate a supported end of elongated tube 222 to receive a retaining clip such as a C-clip 256 to retain the tubular spray element within support 210. Other manners of rotatably securing the tubular spray element within support 210 will be appreciated by those of ordinary skill having the benefit of the instant disclosure.

In addition, in some embodiments, a diverter valve arrangement may be incorporated into support 210 to selectively restrict fluid flow to tubular spray element 206 based on the rotational position thereof. One suitable implementation of such a valve arrangement is disclosed, for example, in U.S. patent application Ser. No. 16/795,484, which is assigned to the same assignee as the present application and which is incorporated by reference herein. With such a valve arrangement, a valve body 258 having a radially-facing inlet 246 in fluid communication with an internal channel 260 of tubular spray element 206 may be disposed within a radially-facing valve member 262 disposed at a predetermined radius from the longitudinal axis to substantially block fluid flow to radially-facing inlet 246 when tubular spray element 206 is rotated to a predetermined rotational position about the longitudinal axis.

It will be appreciated that other valve arrangements may be used in other embodiments, and that valve arrangements may also be omitted in some embodiments. Further, it will be appreciated that other locations, sizes and configurations of fluid inlets may be used as an alternative to fluid inlet 246, e.g., defined on an end surface of elongated tube 222 proximate annular groove 254.

It will be appreciated that by utilizing one or more lengthwise portions in elongated tube 222 that incorporate slots and therefore do not fully circumscribe the elongated tube substantially facilitates molding the elongated tube 222 from a polymer material, since supporting fully circumscribed tubes from the inside during molding is generally difficult or impossible, particularly in high aspect ratio designs. The combination of lengthwise portions 228 and 230, which are largely U-shaped and largely O-shaped in cross-section, respectively, thus provides a relatively good approximation of a integral tube, while also supporting additional integrated structures such as gears. It will be appreciated that multiple U-shaped and/or O-shaped portions may be used in other embodiments and interleaved with one another to provide similar advantages. Further, the incorporation of annular ribs, as well as incorporating O-shaped portions proximate the gear and the support end of the tubular spray element (e.g., where the tubular spray element engages bearings 248, 250) further enhances the rigidity and strength of the design.

Manufacture of a tubular spray element consistent with some embodiments of the invention therefore may include molding of the elongated tube, as well as the gear or any other additional structures, from a polymer material such as raw or blended (e.g., using glass, calcium, talc, etc.) versions of polypropylene, acetal, nylon, etc., and using injection molding or another suitable plastic molding process. Further, if a molded elongated cap is used, the elongated cap may also be molded from the same or a different polymer material. In some embodiments, when molding the elongated tube, a generally standard core/cavity configuration may be used with a single action coming from the support side to form the interior/exterior of lengthwise portion 230 as well as gear 218. The elongated cap may thereafter be secured to the elongated tube, e.g., using fasteners, adhesives, snap-fit arrangements, or in the illustrated embodiment, welding. Various welding techniques, such as vibration welding, ultrasonic welding, laser welding, etc., may be used.

Other modifications may be made to the illustrated embodiments without departing from the spirit and scope of the invention. Therefore, the invention lies in the claims hereinafter appended.

What is claimed is:

1. A dishwasher, comprising:

a wash tub;

a fluid supply configured to supply a wash fluid; and a tubular spray element disposed within the wash tub and being rotatable about a longitudinal axis thereof, the tubular spray element including a plurality of apertures in fluid communication with the fluid supply through an internal channel of the tubular spray element to direct wash fluid into the wash tub, the tubular spray element further including:

an elongated tube formed of a molded polymer material and including an elongated slot formed in a sidewall thereof and open to the internal channel of the tubular spray element, the elongated slot extending in a direction generally parallel to the longitudinal axis along a first lengthwise portion of the elongated tube, the elongated tube further including a second lengthwise portion in which the sidewall extends fully around a circumference of the elongated tube; and an elongated cap secured to the elongated tube and extending in the direction generally parallel to the longitudinal axis, the elongated cap sized and configured to cover the elongated slot.

2. The dishwasher of claim 1, wherein the elongated cap is formed of a molded polymer material, and wherein the elongated cap is secured to the elongated tube using vibration, ultrasonic or laser welding.

3. The dishwasher of claim 1, wherein the elongated tube includes a generally planar support surface extending along opposing sides of the elongated slot and supporting the elongated cap.

4. The dishwasher of claim 3, wherein the generally planar support surface extends into the second lengthwise portion of the elongated tube and at an end of the elongated slot to support a portion of the elongated cap.

5. The dishwasher of claim 1, wherein the plurality of apertures are disposed in the elongated cap.

6. The dishwasher of claim 1, wherein the first lengthwise portion is generally U-shaped in cross-section and the second lengthwise portion is generally O-shaped in cross-section.

7. The dishwasher of claim 1, wherein the first lengthwise portion includes a plurality of annular ribs extending in transverse planes relative to the longitudinal axis.

8. The dishwasher of claim 1, wherein the tubular spray element further comprises a drive member coupled to the second lengthwise portion of the elongated tube, and wherein the dishwasher further comprises a tubular spray element drive operably coupled to the drive member to rotate the tubular spray element about the longitudinal axis.

9. The dishwasher of claim 8, wherein the drive member comprises a gear.

10. The dishwasher of claim 9, wherein the gear is integrally molded with the elongated tube.

11. The dishwasher of claim 10, wherein the gear includes first and second opposing sides and is positioned at an intermediate location of the second portion of the elongated tube such that the second portion of the elongated tube extends lengthwise from both opposing sides of the gear.

12. The dishwasher of claim 8, further comprising a tubular spray element support disposed on a wall of the wash tub and configured to support the tubular spray element on the wall of the wash tub in a cantilevered fashion, the tubular spray element support including a fluid inlet in fluid communication with the fluid supply and configured to communicate wash fluid from the fluid supply to the tubular spray element, wherein the tubular spray element support includes an aperture through which the tubular spray element projects, and wherein the tubular spray element support is configured to retain the drive member.

13. The dishwasher of claim 12, wherein the fluid inlet is a first fluid inlet, and wherein the tubular spray element includes a second fluid inlet disposed within the tubular spray element support to receive wash fluid that is communicated along the elongated tube to the plurality of apertures.

14. The dishwasher of claim 13, further comprising first and second bearings disposed within the tubular spray element support to rotatably support the tubular spray element at respective first and second locations along the longitudinal axis thereof.

15. The dishwasher of claim 14, wherein the elongated tube includes an annular groove disposed proximate a first end of the elongated tube to receive a retaining clip that retains the tubular spray element within the tubular spray element support.

16. The dishwasher of claim 13, further comprising a valve body having a radially-facing inlet in fluid communication with an internal channel of the tubular spray element, and wherein the tubular spray element support includes a radially-facing valve member disposed at a predetermined radius from the longitudinal axis to substantially block fluid flow from the inlet of the tubular spray element support to the radially-facing inlet when the tubular spray element is rotated to a predetermined rotational position about the longitudinal axis.

17. A tubular spray element configured to spray wash fluid from a fluid supply into a wash tub of a dishwasher, the tubular spray element comprising:

an elongated tube configured to rotate about a longitudinal axis, the elongated tube formed of a molded polymer material and including an elongated slot formed in a sidewall thereof and extending in a direction generally parallel to the longitudinal axis along a first lengthwise portion of the elongated tube, the elongated tube further including a second lengthwise portion in which the sidewall extends fully around a circumference of the elongated tube;

an elongated cap secured to the elongated tube and extending in the direction generally parallel to the longitudinal axis, the elongated cap sized and configured to cover the elongated slot; and a plurality of apertures disposed in at least one of the elongated tube and the elongated cap, the plurality of apertures configured to receive wash fluid from the fluid supply through an internal channel of the tubular spray element and direct the wash fluid externally from the tubular spray element and into the wash tub, wherein the elongated slot is open to the internal channel of the tubular spray element.

18. The tubular spray element of claim 17, further comprising a gear integrally molded with the elongated tube and rotating in a plane that is generally transverse to the longitudinal axis, wherein the gear includes first and second opposing sides and is positioned at an intermediate location of the second portion of the elongated tube such that the second portion of the elongated tube extends lengthwise from both opposing sides of the gear.

19. The tubular spray element of claim 17, wherein the elongated cap is formed of a molded polymer material and is secured to the elongated tube using vibration, ultrasonic or laser welding, wherein the plurality of apertures are disposed in the elongated cap, wherein the first lengthwise portion is generally U-shaped in cross-section and the second lengthwise portion is generally O-shaped in cross-section, and wherein the first lengthwise portion includes a plurality of annular ribs extending in transverse planes relative to the longitudinal axis.

* * * * *